United States Patent [19]

Andersson et al.

[11] Patent Number: 4,648,440

[45] Date of Patent: Mar. 10, 1987

[54] APPARATUS FOR THE CONTINUOUS CASTING OF METAL

[75] Inventors: Conny Andersson; Sten Kollberg, both of Västerås, Sweden

[73] Assignee: Asea AB, Västerås, Sweden

[21] Appl. No.: 410,885

[22] Filed: Aug. 24, 1982

Related U.S. Application Data

[63] Continuation-in-part of Ser. No. 266,003, May 21, 1981, abandoned, which is a continuation of Ser. No. 99,079, Nov. 30, 1979, abandoned.

[30] Foreign Application Priority Data

Dec. 1, 1978 [SE] Sweden ..... 7812382

[51] Int. Cl.[4] ..... B22D 11/128; B22D 27/02

[52] U.S. Cl. ..... 164/504; 164/442

[58] Field of Search ..... 164/468, 504, 441, 442, 164/447, 448

[56] References Cited

U.S. PATENT DOCUMENTS 4,076,069 2/1978 Scheinecker et al. ..... 164/448

4,164,252 8/1979 Scheurecker ..... 164/448

FOREIGN PATENT DOCUMENTS 53-16365 5/1978 Japan ..... 164/504

*Primary Examiner*—Kuang Y. Lin

*Attorney, Agent, or Firm*—Kenyon & Kenyon

[57] ABSTRACT

A continuous casting apparatus has a plurality of non-magnetic rollers which contact a side of a continuously cast traveling strand. To support each roller against bending, the roller is journaled at its opposite ends and also at least at one interposed position between its ends to define roller lengths between each two of the bearings. Inductive stirrers providing traveling magnetic flux fields extending for the full extent of each length in each instance, are positioned on the outside of such roller length so as to project flux fields without interruption through the roller between its journaled ends and the interposed journaling position. Uniform uninterrupted fields are provided regardless of the strand's width.

1 Claim, 1 Drawing Figure

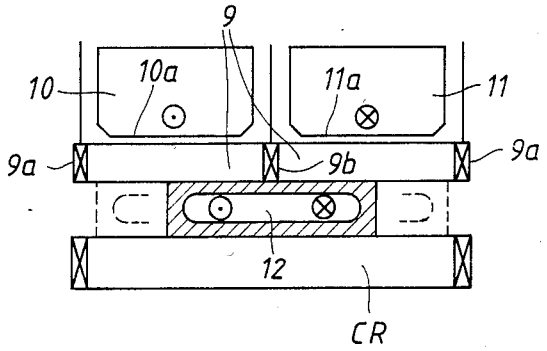
9
10
10a
11a
11
9a
9b
9a
12
CR

APPARATUS FOR THE CONTINUOUS CASTING OF METAL

This is a continuation-in-part of application Ser. No. 266,003 filed May 21, 1981, now abandoned, which is a continuation of Ser. No. 99,079 filed Nov. 30, 1979, now abandoned.

The advantages of inductively stirring the molten metal within the solidified skin of a traveling continuously cast strand leaving a continuous casting mold, are well known.

Such inductive stirring is effected by commercially available inductive stirrers which are usually straight and elongated with pole pieces or faces with windings which when energized by a traveling multi-phase electric current, project forwardly a traveling magnetic field which, if it can be made to project into the molten metal within the strand effectively, provides inductive stirring of the molten metal so as to produce a sounder cast strand than would otherwise be possible.

In continuous casting, particularly in the case of steel, the cast strand leaving the continuous casting mold has at least its opposite sides held and guided by an extended series of closely interspaced mutually parallel rollers which both guide the traveling strand and support its skin against a molten metal breakout. The strand leaving the continuous casting mold has a solidified skin supported by the rollers below the mold and containing as yet unsolidified molten metal within the skin, the strand, after traveling a sufficient distance from the mold for cooling, eventually becoming solidified throughout.

The closer the inductive stirrer can be to the cast strand, the more effective is the molten metal stirring. It may be desirable to use a multiplicity of stirrers distributed along the traveling strand guided and supported by the roller series. The rollers are normally made of magnetic steel journaled by suitable bearings and preferably having a uniform roller spacing pitch throughout the series. At each inductive stirring position some of the rollers can be removed to permit the inductive stirrer to be positioned close to the traveling strand, but this is undesirable because the strand's skin is unsupported throughout that area.

The Andersson U.S. Pat. No. 4,139,048, Feb. 13, 1979, proposed for each of the inductive stirrer positions, the substitution of non-magnetic metal rollers for the usual magnetic metal rollers normally used for the roller series guiding the continuously traveling casting strand. The non-magnetic rollers provide what is, in effect, a window, so that with the inductive stirrer positioned close to the outsides of these non-magnetic rollers, the traveling magnetic flux field can be projected through the rollers, or window, and the strand skin, into the molten metal so as to inductively stir the latter.

Non-magnetic rollers of smaller diameter than usual are preferable, but require journaling at interposed positions between their ends, to prevent the rollers from bending under the stress they receive from their contact with the traveling strand.

The continuous casting molds can be interchanged with others to permit the casting of strand having different widths. For example, slabs may have widths ranging up to 2600 mm, while blooms may have widths no greater than 700 mm. Strands intended for billets may have widths of less than 160 mm. To accommodate this range of widths, normally the stirrer must be wide enough to project a field as wide as will ever be required, or in other words, up to 2600 mm, for example. The use of non-magnetic rollers of reduced diameter would inherently involve one or more of the interposed bearings resisting roller bending, to be directly in the path of the wide traveling flux field of the wide stirrer. Although such bearings are of small axial extent relative to the rollers lengths, they and their necessary carriers or supports would materially disturb the stirrer's wide flux field.

Briefly summarized, according to the present invention, each of the non-magnetic, strand supporting rollers can be of the smaller diameter requiring at least one interposed bearing between its end bearings. This is made possible by providing each length of each roller between each two of its bearings with an inductive stirrer of less width than described above, but having a width substantially coextensive with the roller length between the bearings. This requires two or more of such stirrers, but because they can be positioned closely together, they can jointly act to project a wide substantially undisturbed field throughout the width of the strand, regardless of the width of the strand.

In other words, for each non-magnetic roller having its end journaled by bearings and at least one bearing interposed between its ends so that the roller is divided into at least two lengths by the bearings, there are at least two stirrers each having a field projecting face that extends as completely as possible throughout the entire length of each of the roller lengths.

In the case of a slab having the maximum width accommodated by the overall roller length, the fields from the stirrers provide substantially the same field that would be obtained by a single wide stirrer designed to accommodate the maximum strand width to be stirred. On the other hand, strands of bloom width can be fed symmetrically with respect to the roller with the two stirrer fields acting together to provide a substantially undisturbed field. The same concept prevails in the case of billets of even narrower width.

The stirring action obtained with the multiplicity of stirrers and the advantageous use of the smaller sized strand support rollers necessarily using interposed bearings between their end bearings, with this invention is substantially the same as can be obtained by the use of the larger diameter non-magnetic strand support rollers having only end bearings, and full width stirrers projecting their fields through the rollers. The air gap through which the field must be projected is shortened by the use of the smaller diameter non-magnetic rollers, the flux field interference of the necessary interposed bearing is substantially eliminated, and the stirring action can be substantially the same as with the larger non-magnetic rollers and full width stirrers.

BRIEF DESCRIPTION OF THE DRAWING

The accompanying drawing is for use in connection with the following more detailed description of the invention, the single figure schematically illustrating the invention in a view looking downwardly with the strand in cross section, when using a non-magnetic roller having an interposed bearing between its end bearings and using two stirrers.

Referring to the above, it can be seen that the roller 9 is of the smaller diameter as compared to the counter roll CR which has the diameter of the other and usually magnetic rollers of the series of rollers required to guide the strand from its continuous casting mold while the strand solidifies. The roller 9 has the end bearings 9*a* and the interposed bearing 9*b* required to prevent the roller from bending. Two stirrers 10 and 11 are shown positioned on opposite sides of the interposed bearing 9*b* which divides the roller 9 into its two lengths, and the front faces 10*a* and 11*a* of the stirrers are in each case substantially coextensive with each length of the roller between the interposed bearing 9*b* and the end bearing 9*a*.

As illustrated, the continuously cast strand 12 is shown as having the width of a bloom and as being positioned symmetrically with respect to the overall length of the roller 9, the interposed bearing 9*b* of the latter being symmetrically positioned between the end bearings 9*a*. In addition, as is illustrated, the stirrers 10 and 11 are symmetrically positioned on either side of the symmetrically positioned interposed bearing 9*b*. The traveling fields of the two stirrers 10 and 11 are indicated as traveling in opposite direction, but they can travel in the same direction, depending on the stirring action desired.

Now it is apparent that the stirring action in the strand 12 can be substantially the same as if one full width stirrer were used, the stirring fields of the stirrers 10 and 11 with their active faces extending substantially for the full length of the opposite length of the roller 9. The field projected by each stirrer is relatively undisturbed by the interposed bearing 9*b* so the stirring obtained is predictable. On the other hand, the same predictable stirring is effected when the strand has a slab width as indicated in phantom by the dotted lines.

If the stirrers 10 and 11 are narrowed in width, the above advantageous result is not obtained. For example, if each stirrer 10 and 11 is narrowed and loaded at the ends of the roller 9*b* close to the end bearings 9*a*, the illustrated bloom 12 would not be stirred at all because it would be too remote from the fields of the two widely separated stirrers.

We claim:

1. Continuous casting apparatus comprising at least one non-magnetic roller which contacts a side of a continuously cast traveling strand of magnetic metal having a solidified skin containing unsolidified metal, said roller being journaled at both of its ends by end bearings and at least one interposed position between said ends by an interposed bearing, each length of said roller between each two of said bearings having an inductive stirrer positioned on the outside thereof and extending longitudinally with respect to the strand and having a front face adapted to project a traveling magnetic field forwardly through said length into said strand, said front face having a width substantially coextensive with said length, in each instance, so as to cause direct inductive stirring of said unsolidified metal throughout the width of said strand regardless of the width of the strand.

* * * * *